US006702451B1

(12) United States Patent
Daane

(10) Patent No.: US 6,702,451 B1
(45) Date of Patent: Mar. 9, 2004

(54) SWIMMING POOL JET LIGHTING

(76) Inventor: Patrick David Daane, 505 Tranquil Dr., Sparks, NV (US) 89436

( * ) Notice: Subject to any disclaimer, the term of this patent is extended or adjusted under 35 U.S.C. 154(b) by 0 days.

(21) Appl. No.: 10/096,717

(22) Filed: Mar. 12, 2002

(51) Int. Cl.[7] ..... F21V 33/00

(52) U.S. Cl. ..... 362/96; 362/101; 362/240; 362/385; 222/113

(58) Field of Search ..... 362/101, 96, 385, 362/267, 251, 364, 365, 240, 276, 802; 222/113

(56) References Cited

U.S. PATENT DOCUMENTS 3,818,428 A 6/1974 Phipps et al.
3,894,689 A 7/1975 Billingsley
4,276,580 A 6/1981 Rogers
4,424,438 A 1/1984 Antelman et al.
D320,862 S 10/1991 Moeller et al.
5,122,936 A * 6/1992 Guthrie ..... 362/101
5,217,292 A * 6/1993 Chalberg ..... 362/96

* cited by examiner

*Primary Examiner*—Sandra O'Shea
*Assistant Examiner*—John A. Ward
(74) *Attorney, Agent, or Firm*—Gene Scott-Patent Law & Venture Group

(57) ABSTRACT

An apparatus comprises an enclosure having a torroidal shaped body adapted for engaging a pool jet water supply pipe. The torroidal body encloses a light projecting device interconnected in an electrical circuit for switching lighting on and off. A water dispensing jet engaged with the water supply pipe directs water into a swimming pool. The light projecting device is adapted for directing light toward the dispensing jet for producing a light show in the directed water and for directing light toward the pool.

4 Claims, 3 Drawing Sheets

SWIMMING POOL JET LIGHTING

BACKGROUND OF THE INVENTION

1. Field of the Invention

This invention relates generally to pool lights and more particularly to a pool jet lighting system.

2. Description of Related Art

The following art defines the present state of this field:

Moeller et al., U.S. Pat. No. D320,862 describes a recessed underwater light for bathtub. Phipps et al., U.S. Pat. No. 3,818,428 describes a floating marine safety light having a pressure actuated switch which enables the light to be carried or stored in an upright position with the circuit open and which will make contact to close the electric circuit to illuminate a safety light when the light is immersed in water. Further, the invention includes means for compensating pressure changes in the light to prevent accidental actuation of the pressure switch due to thermal fluctuations. The invention also includes means for impeding or retarding descent of the safety light when dropped from high elevations, such as from a low flying aircraft.

Billingsley, U.S. Pat. No. 3,894,689 describes an automatic sequentially activated water display fountain system. The fountain system includes an automatic distribution valve which sequentially distributes water through multiple outlets to a plurality of distribution pipes communicating with the valve. Sensors in the form of pressure-sensitive switches monitor the fluid pressure present in each of the distribution pipes. When water is directed to a distribution pipe via the water distribution valve, the associated pressure switch, in turn, energizes an illumination circuit associated with the pressurized distribution pipe creating a pleasing aesthetic effect. In the preferred embodiment, the pressure switch is actuated by a piston. The illumination circuit may include incandescent, fluorescent, or gas lighting.

Rogers, U.S. Pat. No. 4,276,580 describes an improvement to safe electrical systems which have a hermetically enclosed space containing an electrical circuit member wherein means are provided for connecting and disconnecting the electrical circuit member to a power source in response to pressure changes within the hermetically enclosed space and for altering the volume within the hermetically enclosed space to effect a pressure change therein.

Antelman et al., U.S. Pat. No. 4,424,438 describes a control system for selectively turning on and off various electrical devices used in the operation of a spa. The control system includes a power supply for generating a 5 volt DC voltage from a 120 volt AC external power source, a timing circuit, a clearing circuit and a plurality of control circuits, one for each device to be controlled. Each control circuit, which is driven by the 5 volt DC voltage, includes a relay which is adapted to be coupled to the electrical device to be controlled, a momentary manually operated switch, a pair of flip-flops, a gate, a transistor, and an incadescent light bulb. In the operation of the circuit the transistor is turned on and off by the flip-flops and the output of the transistor is used to energize or deenergize the relay. Because the circuits operate at low DC voltage, the switches through which these voltages are transmitted can be located at or near the spa without causing potential safety problems. In a specific embodiment disclosed, an air blower pump, a booster pump, a circulating pump and a heater are controlled and the lighted switches are located in a first box adapted to be located at the vicinity of the spa. The first box is connected by wires to a second box containing the other components and is adapted to be located remote from the spa, preferably in the vicinity of the electrical devices being controlled. Integrated circuits and passive parts are used for all components in the control system.

Guthrie, U.S. Pat. No. 5,122,936 describes a below water light assembly for mounting on a wall surface of a pool, including a backing plate which is located adjacent said surface of the pool when the assembly is mounted on said wall, a lens sealingly mounted in relation to said backing plate and defining a water-tight chamber therewith, and an electric light source or lamp mounted within said chamber and connectable to an electric power source by an electric cable extending from said electric light source or lamp through a water-tight seal in said backing plate. An annular housing member extends around and rearwardly from, the periphery of the backing plate. The annular housing member has a plurality of openings formed around its circumference, such that when said light assembly is mounted on said pool surface, water in the pool is able to circulate through a compartment defined by said surface, the housing member and the backing plate.

The prior art teaches the use of illuminated pool lighting but does not teach the particular adaptation of the present invention which provides novel advantages as described in the following summary.

SUMMARY OF THE INVENTION

The present invention teaches certain benefits in construction and use which give rise to the objectives described below.

The present invention comprises an enclosure having a torroidal shaped body adapted for engaging a pool jet water supply pipe. The torroidal body encloses a light projecting device interconnected in an electrical circuit for switching light on and off. A water dispensing jet engaged with the water supply pipe directs water into a swimming pool. The light projecting device is adapted for directing light toward the dispensing jet for producing a light show in the directed water and for directing light toward the pool.

A primary objective of the present invention is to provide an apparatus and method of use of such apparatus that provides advantages not taught by the prior art.

Another objective is to provide such an invention capable of providing a light show in a swimming pool jet.

A further objective is to provide such an invention capable of activation by rotation of the invention apparatus.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
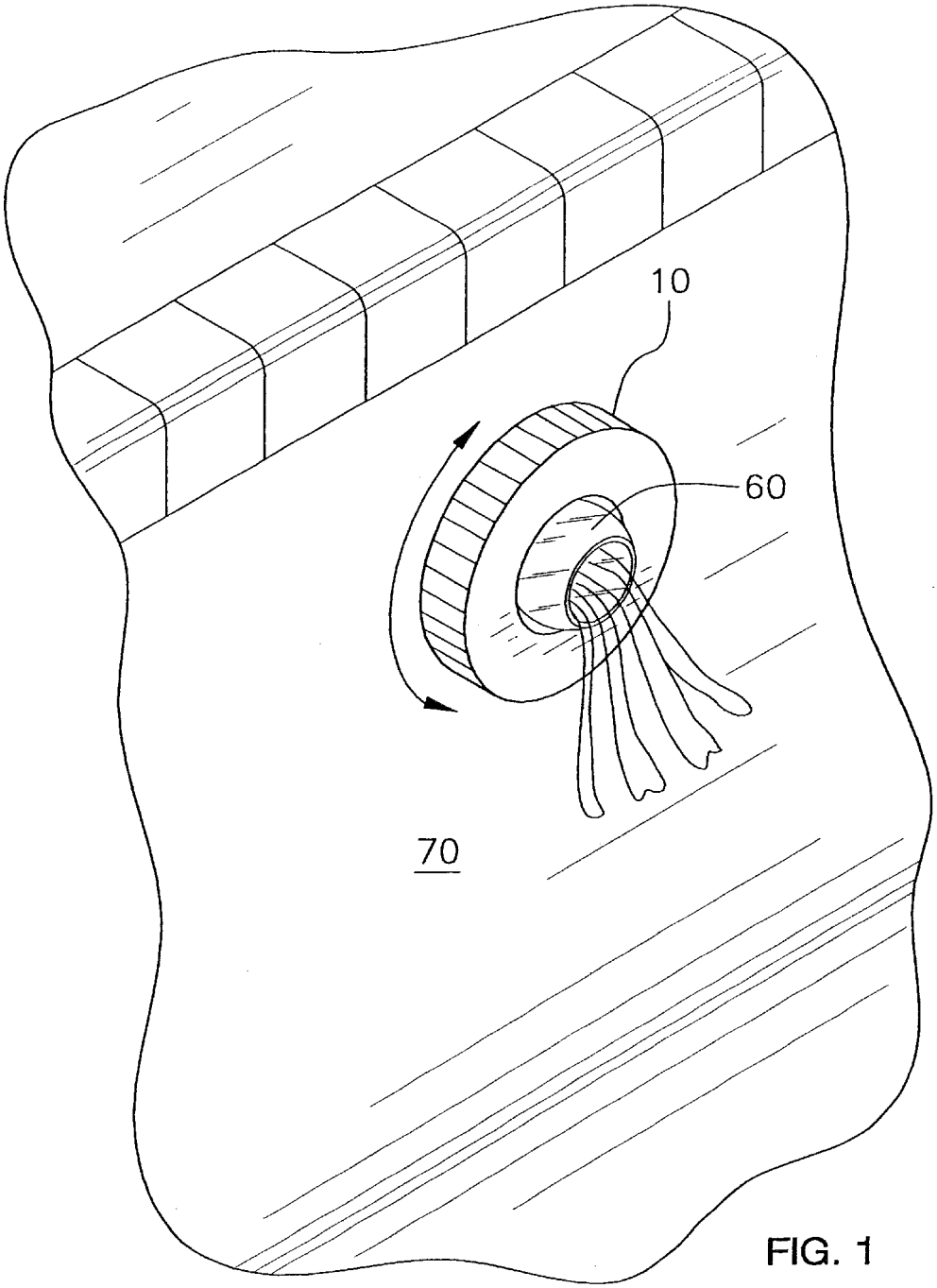
FIG. 1 is a frontal perspective view of the preferred embodiment as mounted on a water jet of a swimming pool.
Figure 2:
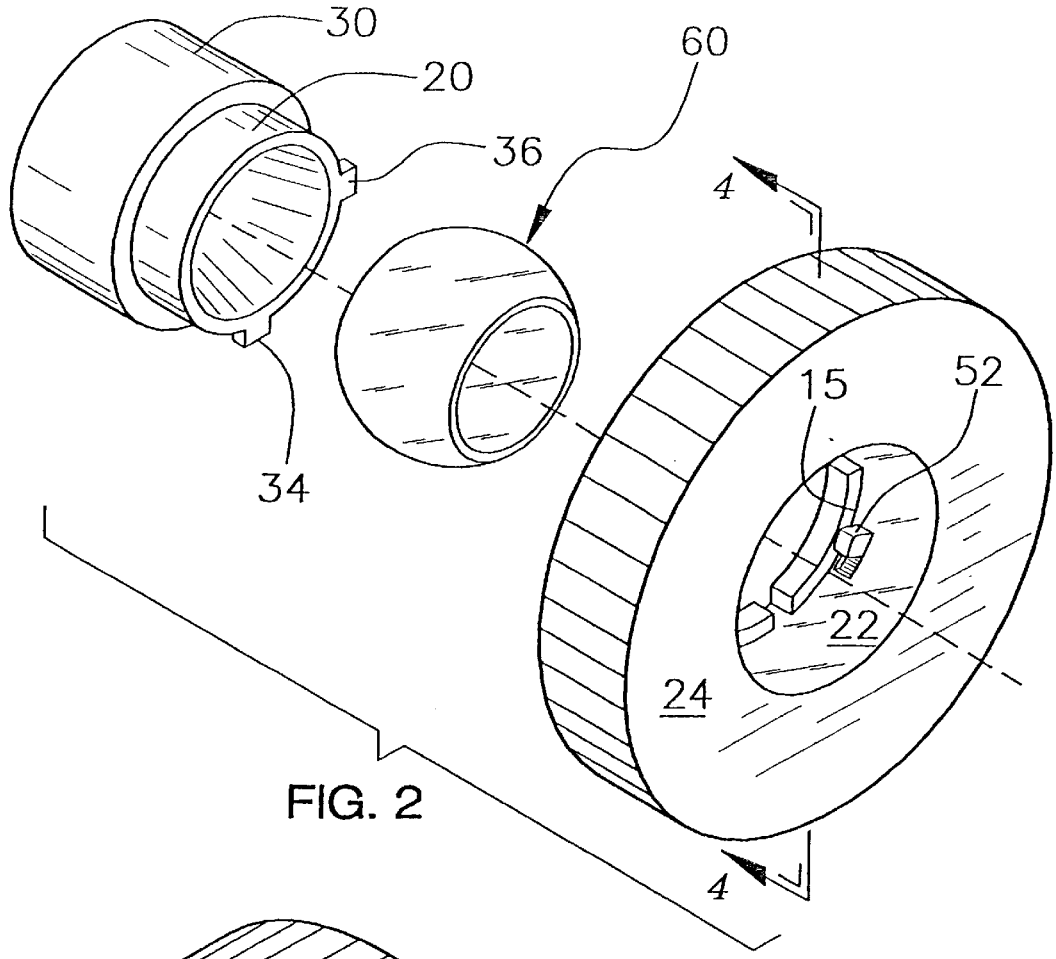
FIG. 2 is a frontal perspective exploded view thereof, showing a water supply pipe, the present invention and a water jet from left to right.
Figure 3:
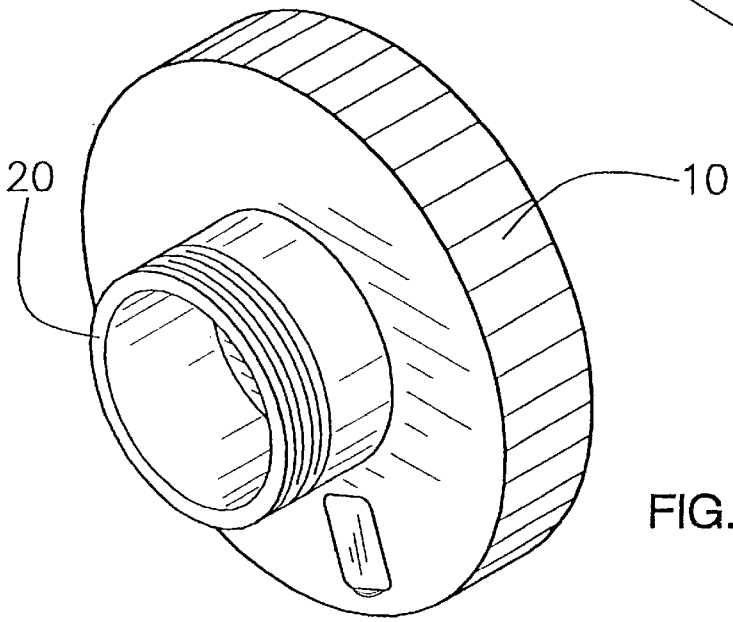
FIG. 3 is a rearwardly oriented perspective view thereof.
Figure 4:
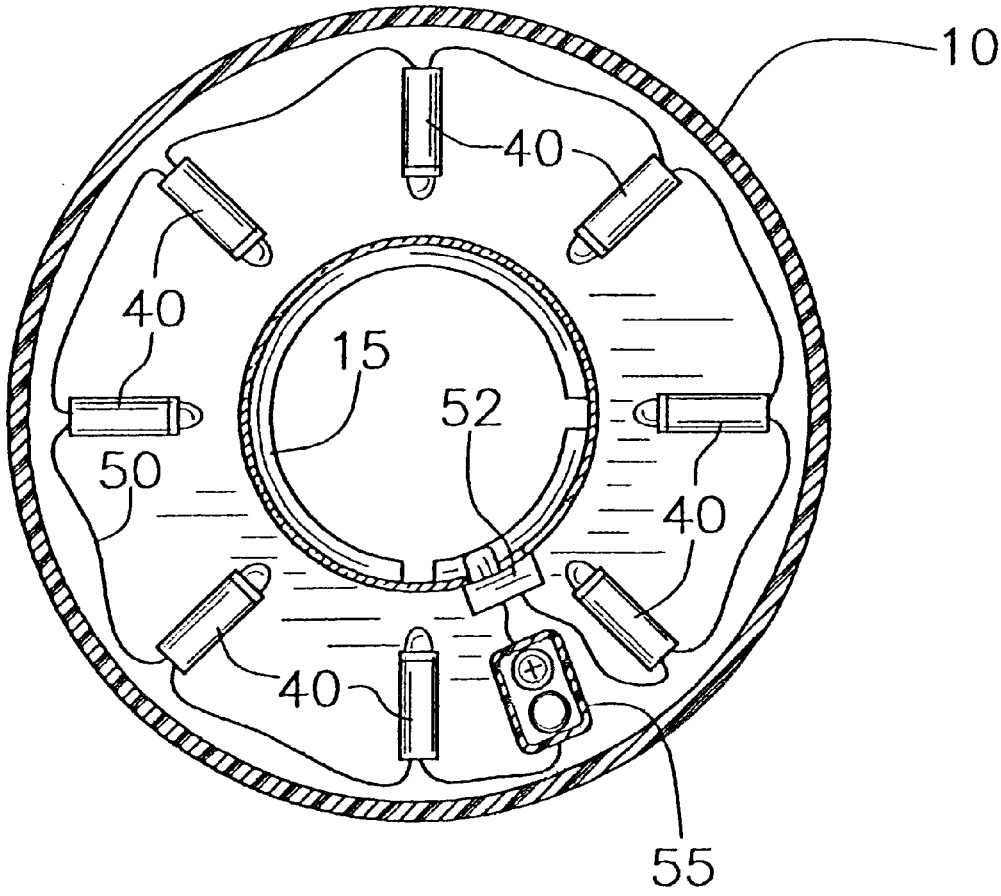
FIG. 4 is section view thereof taken along line 4-4 in FIG. 2 showing interior components of an electrical circuit of the invention.

The present invention apparatus comprises an enclosure 10, preferably of a plastic molded construction, a torroidal shaped body. 20 adapted with exterior threads for engaging a pool jet water supply pipe 30. The enclosure 10 encloses a light projecting means 40, such as common flashlight types or light emitting diode types, etc., interconnected in an electrical circuit 50 for switching the light projecting means 40 on and off. A water dispensing jet 60, of any common type, is engaged, through a twist-lock arrangement between enclosure 10 and torroidal shaped body 20, shown in FIG. 2, with the water supply pipe 30 directing water therethrough into a swimming pool 70 as seen in FIG. 1. The light projecting means 40 is adapted by its position, for instance multiple light sources arrange radially as in FIG. 4, for directing light beams toward the dispensing jet 60 for producing a light show in the directed water as it moves through the jet 60. The electrical circuit 50 comprises the light projecting means 40, an electrical on-off switch 52, as best seen in FIGS. 2 and 4, adapted for engaging a pair of fingers 34, 36 of the torroidal shaped body 20 such that the electrical circuit 50 is -energized and deenergized by rotating the enclosure 10 as shown in FIG. 1. The electrical circuit 50 also comprises a source of electrical power such as battery 55. The fingers 34, 36 press against the switch 52 to move it between the electrical on state and the off state as desired. The fingers 34, 36 also are engaged with an inner annular flange 15 of the enclosure 10 for holding it in place on the torroidal shaped body 20. The enclosure 10 provides an inner cylindrical wall 22 and an outwardly facing front plate 24, as shown in FIG. 2, both of a transparent material for directing light radially toward the jet 60 and outwardly toward the pool 70. Preferably, the dispensing jet is transparent also so that the light may be seen to play on the water as it moves through the jet 60.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising: an enclosure having a torroidal shaped body engaging a pool jet water supply pipe; the torroidal body enclosing a means for projecting light interconnected in an electrical circuit functionally switching the light projecting means on and off; a water dispensing jet engaged with the water supply pipe, the dispensing jet directing water into a swimming pool, the light projecting means directing light toward the dispensing jet, thereby producing a light show in the directed water; the light projecting means comprising plural light sources arranged radially.

2. The apparatus of claim 1 wherein the electrical circuit comprises the light projecting means, an electrical on-off switch adapted for engaging a finger on the water supply pipe such that the electrical circuit is energized by rotating the enclosure.

3. The apparatus of claim 1 wherein the torroidal shaped body provides an inner cylindrical wall and an outwardly facing front plate of a transparent material for directing light therethrough.

4. The apparatus of claim 1 wherein the dispensing jet is transparent.

* * * * *